US009616455B1

(12) United States Patent
Hodges

(10) Patent No.: US 9,616,455 B1
(45) Date of Patent: Apr. 11, 2017

(54) PAINT ROLLER ANTI-ROTATION LOCK

(71) Applicant: Steven D. Hodges, Petaluma, CA (US)

(72) Inventor: Steven D. Hodges, Petaluma, CA (US)

( * ) Notice: Subject to any disclaimer, the term of this patent is extended or adjusted under 35 U.S.C. 154(b) by 0 days.

(21) Appl. No.: 15/350,158

(22) Filed: Nov. 14, 2016

(51) Int. Cl.
*B05C 17/02* (2006.01)

(52) U.S. Cl.
CPC ..... *B05C 17/0237* (2013.01)

(58) Field of Classification Search
CPC .. B05C 17/02; B05C 17/0237; B05C 17/0245
USPC ..... 15/230.11, 246; 492/13.19
See application file for complete search history.

(56) References Cited

U.S. PATENT DOCUMENTS

| | | | |
|---|---|---|---|
| 3,044,094 | A | 7/1962 | Ecker |
| 3,906,581 | A | 9/1975 | Hadnagy et al. |
| 4,196,491 | A | 4/1980 | Baril |
| 5,207,755 | A | 5/1993 | Ampian |
| 5,806,129 | A | 9/1998 | Nelson |
| 5,987,692 | A | 11/1999 | Sizemore |
| 6,405,404 | B2 | 6/2002 | Babkowski |
| 6,574,824 | B2 | 6/2003 | Burns et al. |
| 6,629,658 | B2 | 10/2003 | Lu |
| 7,657,959 | B2 | 2/2010 | Smith et al. |
| 8,302,247 | B2 | 11/2012 | Smith et al. |
| 2005/0011032 | A1 * | 1/2005 | Bosler ..... B05C 17/0237 15/230.11 |
| 2007/0067936 | A1 | 3/2007 | Hodges |
| 2014/0026343 | A1 | 1/2014 | Perreault |

FOREIGN PATENT DOCUMENTS

| | | | |
|---|---|---|---|
| DE | 10209904 | * | 9/2003 |
| DE | 10234654 | * | 4/2004 |
| FR | 1100842 | * | 9/1955 |
| FR | 1103324 | * | 11/1955 |
| GB | 1353027 | * | 5/1974 |
| JP | 59-123564 | * | 7/1984 |
| JP | 9-206661 | * | 8/1997 |
| JP | 2002-282769 | * | 10/2002 |

* cited by examiner

*Primary Examiner* — Mark Spisich
(74) *Attorney, Agent, or Firm* — Robert C Montgomery; Montgomery Patent & Design, LP

(57) ABSTRACT

A paint roller locking mechanism that prevents a roller cover from rotating is designed to apply paint in a smoother manner that typically provided by a roller. The locking mechanism prevents the roller cover from rotating as it is rolled along the surface being painted. This, in effect, allows the roller cover to emulate a paint brush, allowing for a smooth painted surface without surface irregularities. The locking mechanism may easily pivot away allowing the paint roller to function in a normal rolling manner, as well as allow a user to reload the roller or apply bulk paint when needed.

18 Claims, 3 Drawing Sheets

PAINT ROLLER ANTI-ROTATION LOCK

FIELD OF THE INVENTION

The present invention relates generally to a device mountable to a paint roller frame to selectively halt the rotation of the paint roller.

BACKGROUND OF THE INVENTION

All of us know of the burdens, difficulty, and painstaking patience required when performing a painting project. Depending on the particular project, there are a variety of tasks to perform, from removing old paint, cleaning the surface, prepping the surface, mixing the paint, applying the paint, cleaning up and the like. Many of these projects typically utilize a paint roller.

While a paint roller often does a great job of quickly picking up a large quantity of paint and laying down the same upon a surface, a given paint roller is prone to leaving behind an "orange peel" or stippled appearance due to the fact that the roller fibers are pulled away from the surface instead of being dragged across and off like a brush. This requires many painters to spend more time going back over a surface with a brush afterwards to smooth out the newly painted area.

This extra time often results in lost profits for the professional painter. Accordingly, there exists a need for a means by which a smooth finish surface can be obtained by a paint roller alone. The development of the present invention fulfills this need and provides users the ability to paint surfaces with the speed and efficiency of a paint roller, while obtaining the smoothness of a brush-like finish.

SUMMARY OF THE INVENTION

The inventor has recognized the aforementioned inherent problems and lack in the art and observed that there is a need for a paint roller with an anti-rotation lock.

It is therefore an object of the invention to provide an anti-rotation device comprising a clasp which has a hinge that is adapted to be removably attached to a frame of a paint roller, a hollow cylindrical sleeve which is secured in a position that is adjacent from the hinge near the clasp, an anti-rotation trigger which is slideably secured within the sleeve and a cap which is adapted to be secured to a frame cap of the paint roller. The anti-rotation trigger is capable of selectively engaging the cap and thereby arresting the subsequent rotation of the paint roller. The clasp may have a "U"-shaped hook portion which stationarily grips and aligns the sleeve. In an alternate embodiment the hinge may be adapted to be threadably attached to the paint roller frame.

The cap may have at least one (1) aperture which is configured to accommodate at least one (1) fastener and the anti-rotation trigger may have an eyelet at a distal end which is capable of being removably secured about the frame. The anti-rotation trigger may be "L"-shaped.

The cap may comprise of a plurality of prongs which are secured adjacent to a peripheral edge of the cap and project perpendicularly there that edge and/or a frame aperture which enables securement of the frame cap upon the roller frame. Additionally, the cap may further comprise a plurality of screw apertures which enable the cap to be removably secured to the frame cap and may also be disc-shaped.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
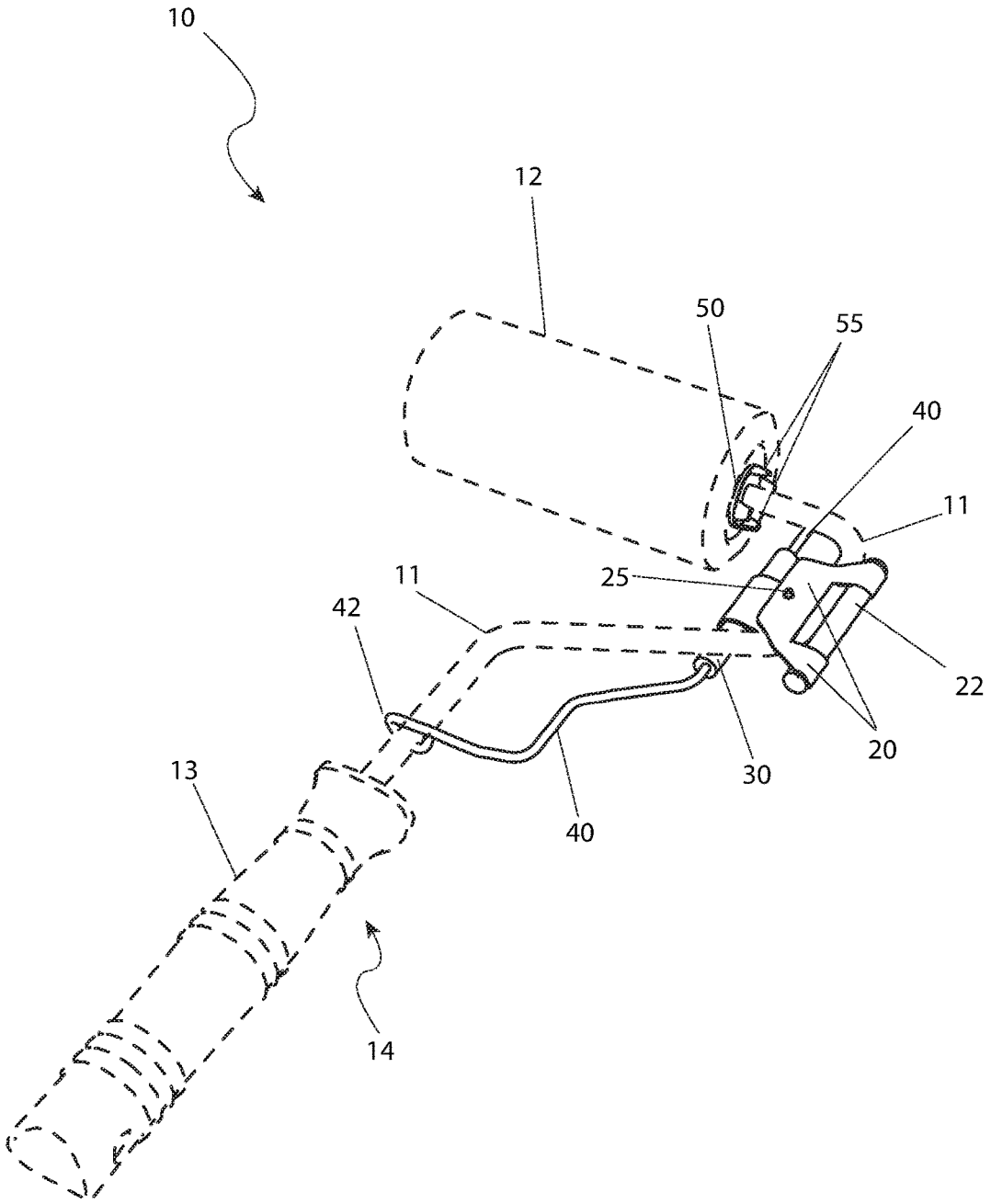
FIG. 1 is an environmental view of an anti-rotation lock 10 for a paint roller, according to a preferred embodiment of the present invention.

10 anti-rotation lock
11 roller frame
12 roller cover
13 roller handle
14 paint roller
20 hinged clasp
22 hinge
25 first fastener
27 "U"-shaped hook portion
30 sleeve
40 anti-rotation trigger
42 eyelet
50 pronged cap
51 frame aperture
52 second fastener
53 screw aperture
55 prong

DETAILED DESCRIPTION OF THE PREFERRED EMBODIMENT

Figure 2:
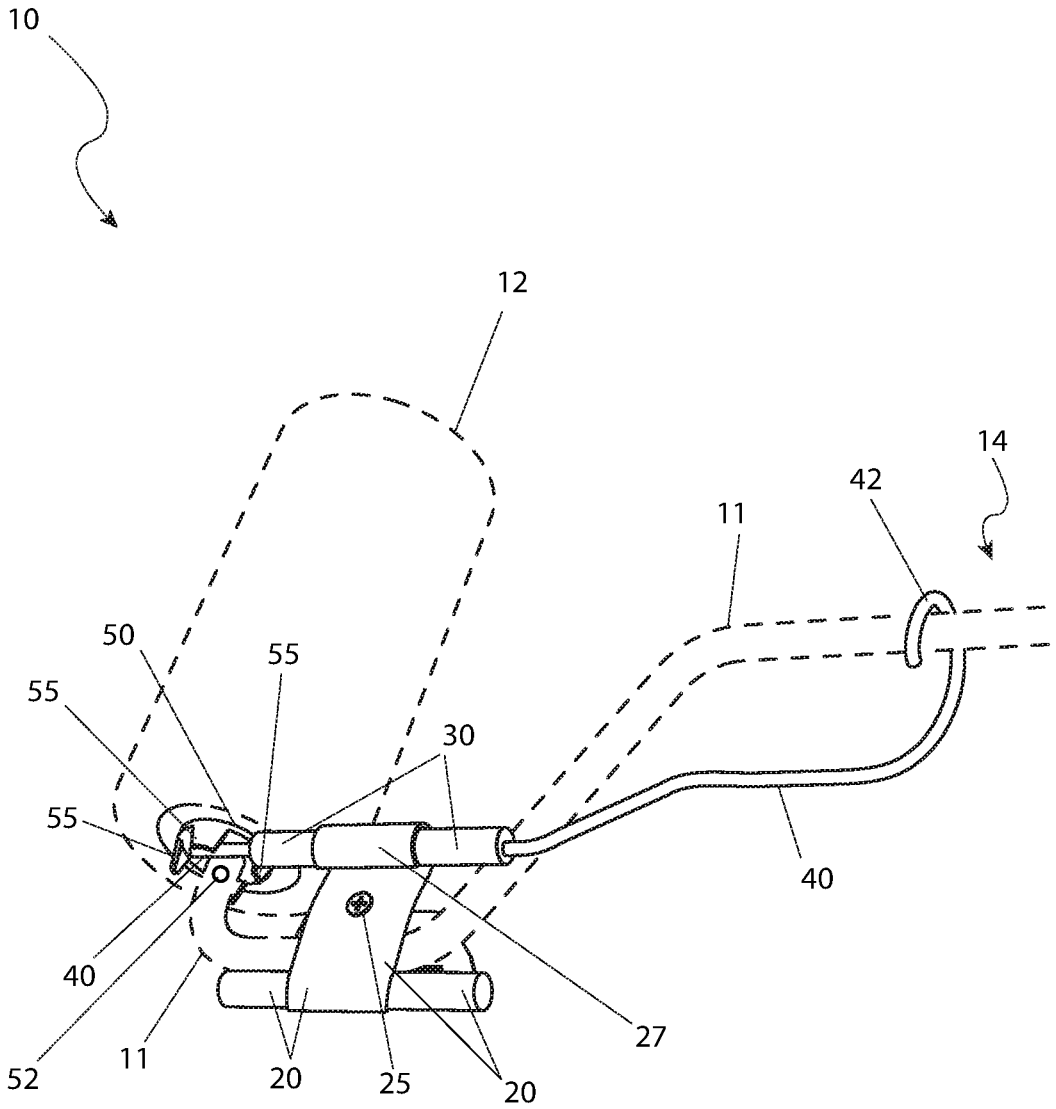
FIG. 2 is another environmental view of the anti-rotation lock 10, according to a preferred embodiment of the present invention; and, FIG. 3 is a perspective view of a pronged cap portion 50 of the anti-rotation lock 10, according to a preferred embodiment of the present invention.
Figure 3:
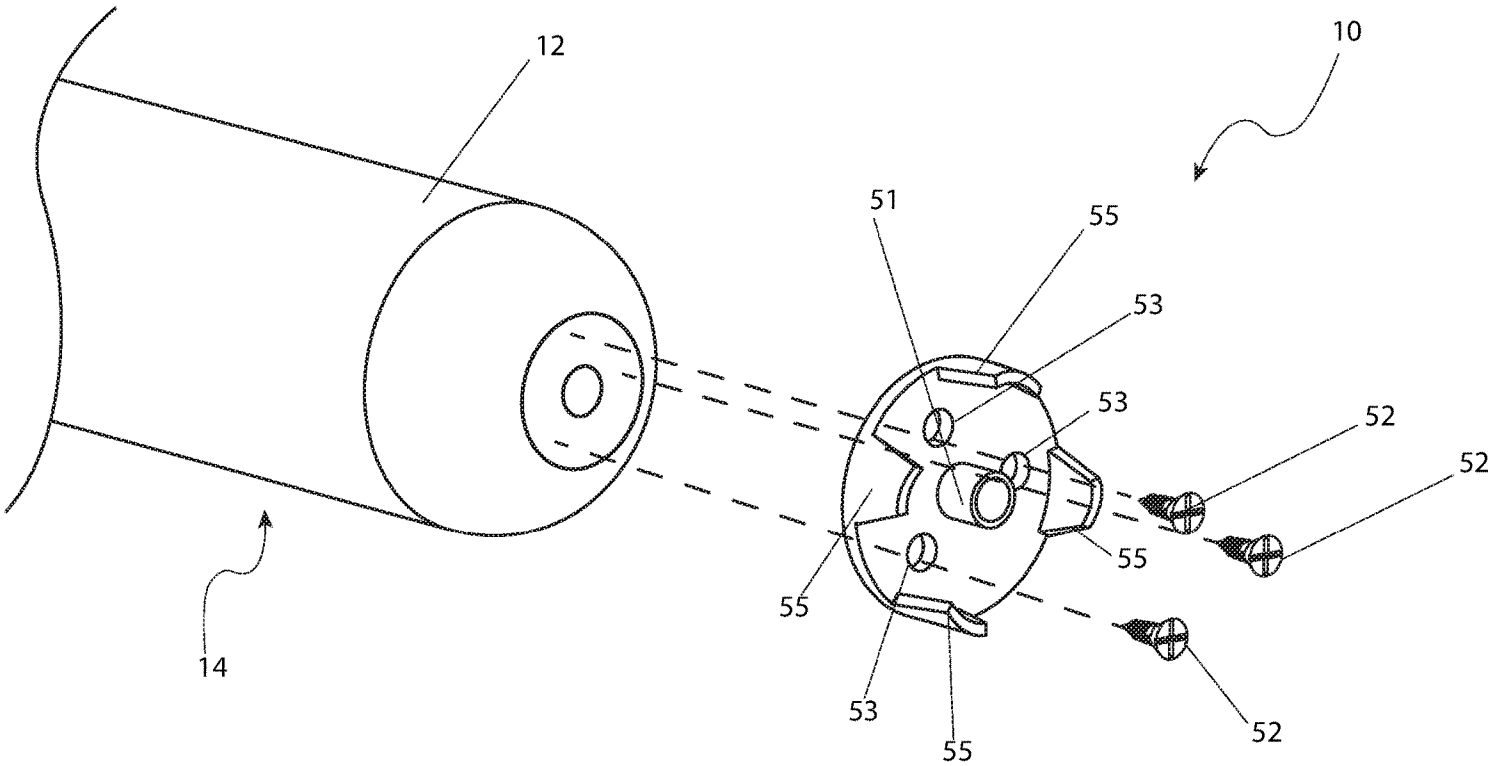

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes an anti-rotation lock for a paint roller (herein described as the "apparatus") 10, which selectively prohibits the rotation of a paint roller cover 12 during roller painting of a surface. The apparatus 10 is utilized in combination with an existing paint roller 14 which conventionally includes a roller frame 11, a roller cover 12, and a roller handle 13. The paint roller 14 transfers paint from the roller cover 12 onto a desired work surface such as a wall or ceiling. The apparatus 10 enables a painter to utilize the paint roller 14 in a normal rolling fashion or in a manner which locks the paint cover 12 in a non-rotating manner, intended to create a smooth paint texture onto the desired surface, producing a similar effect as a painting brush.

Referring now to FIGS. 1 and 2, environmental views of the apparatus 10, according to the preferred embodiment of the present invention, are disclosed. The paint roller 14 is depicted here as a small size unit for illustration sake, however, it is understood that a variety of sizes of the apparatus 10 and corresponding paint rollers 14 may utilize the teachings of the apparatus 10 and therefore should not be interpreted as a limiting factor.

The apparatus 10 includes an "L"-shaped anti-rotation trigger 40, a hollow cylindrical sleeve 30, and a hinged clasp 20 which removably attaches the anti-rotation trigger 40 onto a frame portion 11 of the existing paint roller 14. The sleeve 30 is inserted upon a proximal end portion of the anti-rotation trigger 40, and is integrally-molded, or otherwise secured to the hinged clasp 20, thereby allowing the anti-rotating trigger 40 to rotate freely within the sleeve 30 relative to the hinged clasp 20, during use. The anti-rotation trigger 40 is envisioned to be made using a plastic or metal rod stock material and having an oval-shaped formed eyelet 42 at a distal end portion, providing a means of attachment of the anti-rotating trigger 40 to the roller frame 11.

The hinged clasp 20 forms a "clam-shell" structure which utilizes an axial hinge portion 22 and a threaded first fastener 25 to loosen and tighten the hinged clasp 20 upon the roller frame 11 at a location adjacent to the paint roller 14. The hinged clasp 20 also includes a "U"-shaped hook portion 27 which stationarily grips and aligns the sleeve 30. In use, the first fastener portion 25 is adjusted to allow the hinged clasp 20 to rotate about the roller frame 11 with selective resistance, thereby allowing a user to selectively position the hinged clasp 20 and the affixed anti-rotation trigger 40. The anti-rotating trigger 40 engages a pronged cap portion 50 which in turn prevents rotation of the paint roller 14 and paint cover 12 portions (see FIG. 2).

The eyelet 42 is positioned at a distal end portion of the anti-rotation trigger 40 and encompasses a lower portion of the roller frame 11 being adjacent to the roller handle 13. In use, a user presses upon the hinged clasp 20 to position the proximal end of the anti-rotation trigger 40 between adjacent prong portions 55 of the pronged cap 50 to prevent rotation of the paint cover 12, when desired. It is envisioned that the hinged clasp 20, anti-rotation trigger 40, and the pronged cap 50 are to be mounted upon the paint roller 14 prior to placement of the roller cover 12 and use of the paint roller 14 to perform a painting task.

The apparatus 10 is envisioned to be fabricated from materials such as plastic, metal, or the like and is envisioned to be manufactured in various sizes to accommodate a plurality of standard paint rollers 14 and roller covers 12.

Referring now to FIG. 3, a perspective view of a pronged cap portion 50 of the apparatus 10, according to a preferred embodiment of the present invention, is disclosed. The pronged cap 50 is a disc-shaped structure including a plurality of integral and perpendicularly extending pointed prongs 55 along a perimeter edge which mechanically entrap the anti-rotation trigger 40 in between. The pronged cap 50 also includes a centrally-located cylindrical frame aperture 51 which allows insertion upon the roller frame 11.

In use, a user positions the hinged clasp 20 so as to engage the anti-rotation trigger 40 between adjacent prongs 55 so as to prevent relative rotation of the pronged cap 50 and an installed paint cover 12 (see FIGS. 1 and 2).

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 and 2.

The method of installing and utilizing the apparatus 10 may be achieved by performing the following steps: acquiring the apparatus 10; routing the frame aperture portion 51 of the pronged cap 50 onto the roller frame 11; mounting the pronged cap 50 with the prongs 55 orientated outwardly, by threadingly engaging the second fastener 52 and screw aperture 53 portions; routing the assembly of the hinged clasp 20, sleeve 30, and eyelet portion 42 of the anti-rotation trigger 40 onto the roller frame 11; opening the hinged clasp 20; inserting the roller frame 11 into the hinged clasp 20; tightening the hinged clasp 20 onto the roller frame 11 and tightening the first fastener 25 until obtaining a desired resistance to rotation of the hinged clasp 20; utilizing the paint roller 14 in a normal rolling fashion as desired; prohibiting the rotation of the roller cover 12, when desired, by depressing the hinged clasp 20 so as to position the proximal end of the anti-rotation trigger 40 between the prongs 55; utilizing the apparatus 10 to paint surfaces with the smoothness of a paint brush as desired; and, benefiting from a time-saving and quickly adaptable multi-purpose painting means, afforded a user of the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed:

1. An anti-rotation device, comprising:

a clasp having a hinge adapted to be removably attached to a frame of a paint roller;

a hollow cylindrical sleeve secured in position adjacent said hinge by said clasp;

an anti-rotation trigger slideably secured within said sleeve; and, a cap adapted to be secured to said paint roller;

wherein said anti-rotation trigger is capable of selectively engaging said cap, thereby arresting subsequent rotation of said paint roller.

2. The device of claim 1, wherein said cap has at least one aperture configured to accommodate at least one fastener.

3. The device of claim 1, wherein said anti-rotation trigger further comprises an eyelet at a distal end capable of being removably secured about said frame.

4. The device of claim 3, wherein said anti-rotation trigger is L-shaped.

5. The device of claim 1, wherein said cap comprises a plurality of prongs secured adjacent a peripheral edge thereof and projecting perpendicularly therefrom.

6. The device of claim 5, wherein said cap further comprises a frame aperture enabling securement upon said roller.

7. The device of claim 6, wherein said cap further comprises a plurality of screw apertures enabling said cap to be removably secured to said paint roller.

8. The device of claim 7, wherein said cap is disc-shaped.

9. The device of claim 1, wherein said clasp comprises a U-shaped hook portion which stationarily grips and aligns said sleeve.

10. An anti-rotation device, comprising:

a clasp having a hinge adapted to be threadably attached to a frame of a paint roller;

a hollow cylindrical sleeve secured in position adjacent said hinge by said clasp;

an anti-rotation trigger slideably secured within said sleeve; and, a cap adapted to be secured to said paint roller;

wherein said anti-rotation trigger is capable of selectively engaging said cap, thereby arresting subsequent rotation of said paint roller.

11. The device of claim 10, wherein said cap has at least one aperture configured to accommodate at least one fastener.

12. The device of claim 11, wherein said anti-rotation trigger further comprises an eyelet at a distal end capable of being removably secured about said frame.

13. The device of claim 12, wherein said anti-rotation trigger is L-shaped.

14. The device of claim 10, wherein said cap comprises a plurality of prongs secured adjacent a peripheral edge thereof and projecting perpendicularly therefrom.

15. The device of claim 14, wherein said cap further comprises a frame aperture enabling securement upon said paint roller.

16. The device of claim 15, wherein said cap further comprises a plurality of screw apertures enabling said cap to be removably secured to said paint roller.

17. The device of claim 16, wherein said cap is disc-shaped.

18. The device of claim 10, wherein said clasp comprises a U-shaped hook portion which stationarily grips and aligns said sleeve.

* * * * *